US005482456A

United States Patent [19]

Jwayad et al.

[11] Patent Number: 5,482,456

[45] Date of Patent: Jan. 9, 1996

[54] LIGHT FIXTURE CANDLE ADAPTER

[76] Inventors: Jack M. Jwayad; Roberta F. Jwayad, both of 6705 N. Burrage, Portland, Oreg. 97217

[21] Appl. No.: 376,140

[22] Filed: Jan. 20, 1995

[51] Int. Cl.[6] ..... F23D 3/16

[52] U.S. Cl. ..... 431/297; 431/295; D26/20

[58] Field of Search ..... 431/297, 292, 431/295; 362/161–163, 392, 447; D26/13, 20

[56] References Cited

U.S. PATENT DOCUMENTS 3,855,464 12/1974 Angelo ..... 431/297

OTHER PUBLICATIONS

Partylite Catalog. 1994, p. 5, P.O. Box 976, Plymouth, Mass. 02362.

Photographs of the product illustrated within the Partylite Catalog 1994, p. 5, P.O. Box 976, Plymouth, Mass. 02362.

*Primary Examiner*—Carroll B. Dority

[57] ABSTRACT

An adapter for supporting a candle relative to a light fixture. The inventive device includes a mounting assembly engagable to a light socket of the light fixture. A candle engaging assembly is removably coupled to the mounting assembly for supporting a candle and capturing wax dripping therefrom.

6 Claims, 3 Drawing Sheets

Fig. 5
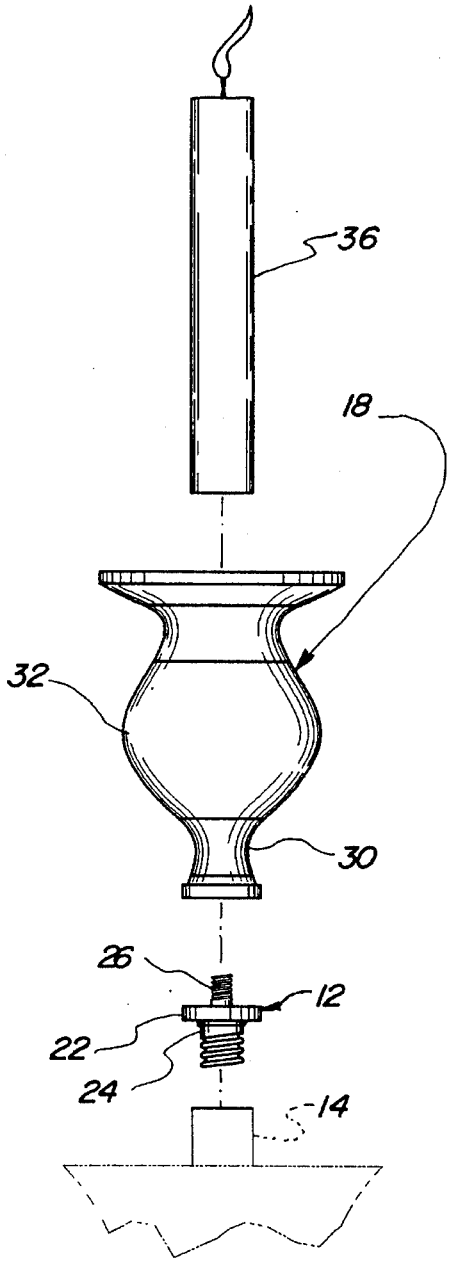
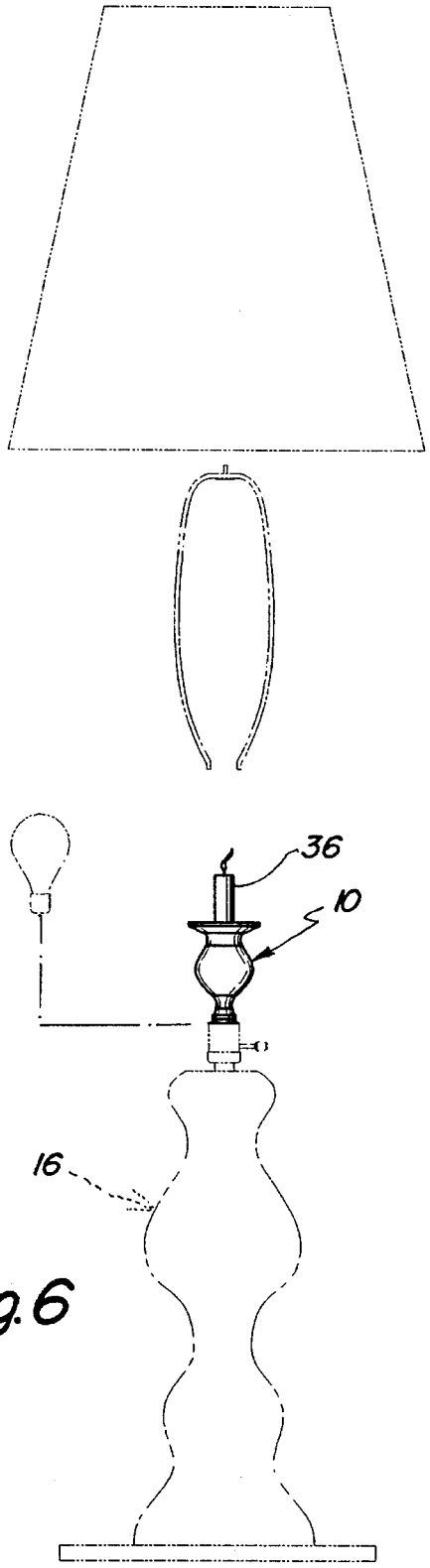
Fig. 6

LIGHT FIXTURE CANDLE ADAPTER

BACKGROUND OF THE INVENTION

1. Field of the Invention

The present invention relates to holding devices and more particularly pertains to a light fixture candle adapter for supporting a candle relative to a light fixture.

2. Description of the Prior Art

The use of holding devices is known in the prior art. More specifically, holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding devices include U.S. Pat. Nos. 3,561,683; 3,473,014; 3,564,235; and 4,260,365.

While these devices fulfill their respective, particular objectives and requirements, the aforementioned patents do not disclose a light fixture candle adapter for supporting a candle relative to a light fixture which includes a mounting assembly engagable to a light socket of the light fixture, and a candle engaging assembly removably coupled to the mounting assembly for supporting a candle and capturing wax dripping therefrom.

In these respects, the light fixture candle adapter according to the present invention substantially departs from the conventional concepts and designs of the prior art, and in so doing provides an apparatus primarily developed for the purpose of supporting a candle relative to a light fixture and capturing wax dripping therefrom.

SUMMARY OF THE INVENTION

In view of the foregoing disadvantages inherent in the known types of holding devices now present in the prior art, the present invention provides a new light fixture candle adapter construction wherein the same can be utilized for supporting a candle relative to a light fixture. As such, the general purpose of the present invention, which will be described subsequently in greater detail, is to provide a new light fixture candle adapter apparatus and method which has many of the advantages of the holding devices mentioned heretofore and many novel features that result in a light fixture candle adapter which is not anticipated, rendered obvious, suggested, or even implied by any of the prior art holding devices, either alone or in any combination thereof.

To attain this, the present invention generally comprises an adapter for supporting a candle relative to a light fixture. The inventive deice includes a mounting assembly engagable to a light socket of the light fixture. A candle engaging assembly is removably coupled to the mounting assembly for supporting a candle and capturing wax dripping therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light fixture candle adapter apparatus and method which has many of the advantages of the holding devices mentioned heretofore and many novel features that result in a light fixture candle adapter which is not anticipated, rendered obvious, suggested, or even implied by any of the prior art holding devices, either alone or in any combination thereof.

It is another object of the present invention to provide a new light fixture candle adapter which may be easily and efficiently manufactured and marketed.

It is a further object of the present invention to provide a new light fixture candle adapter which is of a durable and reliable construction.

An even further object of the present invention is to provide a new light fixture candle adapter which is susceptible of a low cost of manufacture with regard to both materials and labor, and which accordingly is then susceptible of low prices of sale to the consuming public, thereby making such light fixture candle adapters economically available to the buying public.

Still yet another object of the present invention is to provide a new light fixture candle adapter which provides in the apparatuses and methods of the prior art some of the advantages thereof, while simultaneously overcoming some of the disadvantages normally associated therewith.

Still another object of the present invention is to provide a new light fixture candle adapter for supporting a candle relative to a light fixture and capturing wax dripping therefrom.

Yet another object of the present invention is to provide a new light fixture candle adapter which includes a mounting assembly engagable to a light socket of the light fixture, and a candle engaging assembly removably coupled to the mounting assembly for supporting a candle relative to the light fixture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded elevation view of the present invention.

FIG. 6 is a front elevation view of the candle adapter in use with an alternative light fixture structure.

DESCRIPTION OF THE PREFERRED EMBODIMENT

Figure 1:
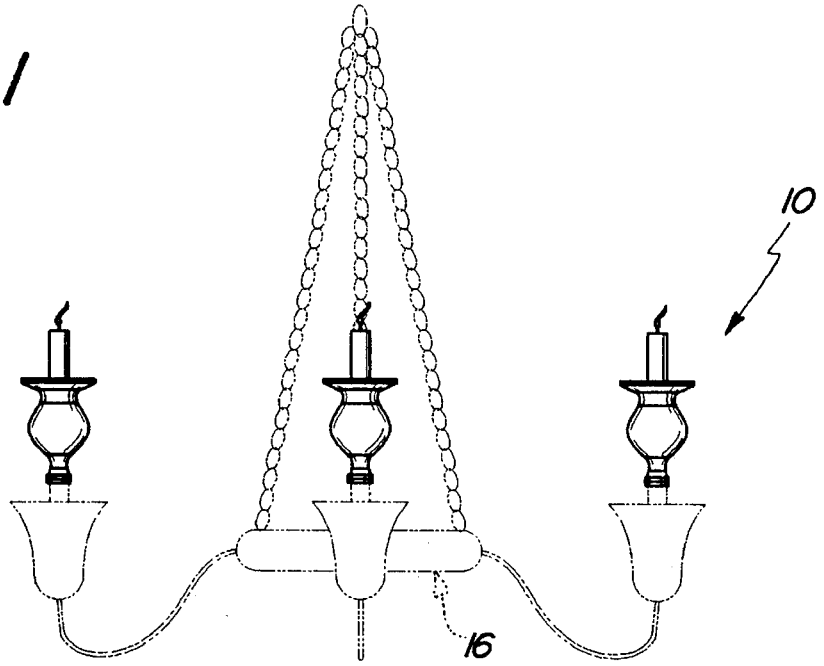
FIG. 1 is a front elevation view of a plurality of light fixture candle adapters according to the present invention in use.
Figure 2:
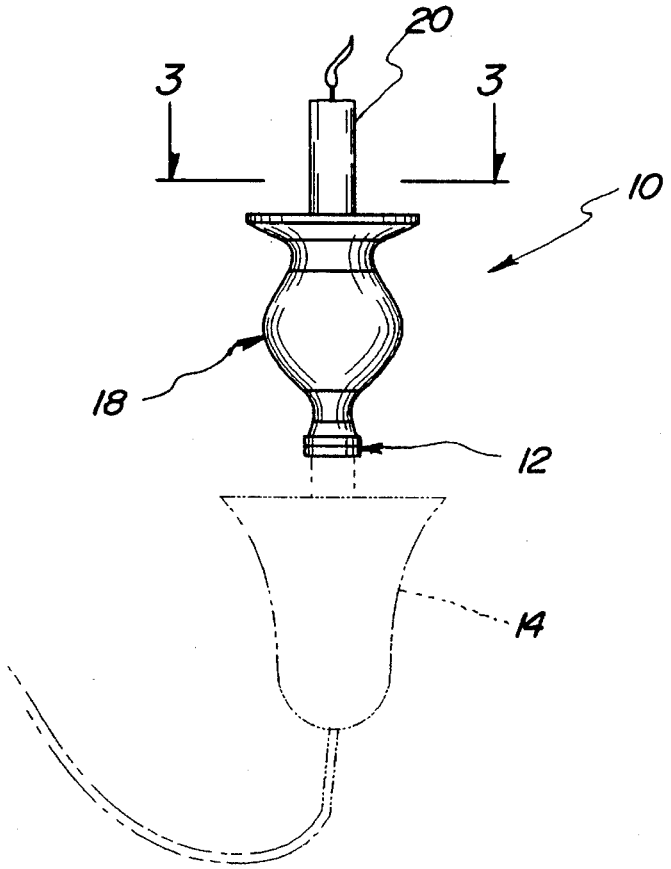
FIG. 2 is a front elevation view of a single light fixture candle adapter in use.

With reference now to the drawings, and in particular to FIGS. 1–6 thereof, a new light fixture candle adapter embodying the principles and concepts of the present invention and generally designated by the reference numeral 10 will be described.

More specifically, it will be noted that the light fixture candle adapter 10 comprises a mounting means 12 for coupling to a light socket 14 of an associated light fixture 16, such as the chandelier illustrated in FIG. 1 of the drawings. A candle engaging means 18 is removably coupled to the mounting means 12 and operates to receive and support a candle 20 relative to the mounting means and the associated light fixture 16, as well as to capture wax dripping from the candle 20 in a manner which will subsequently be described in more detail.

Figure 4:
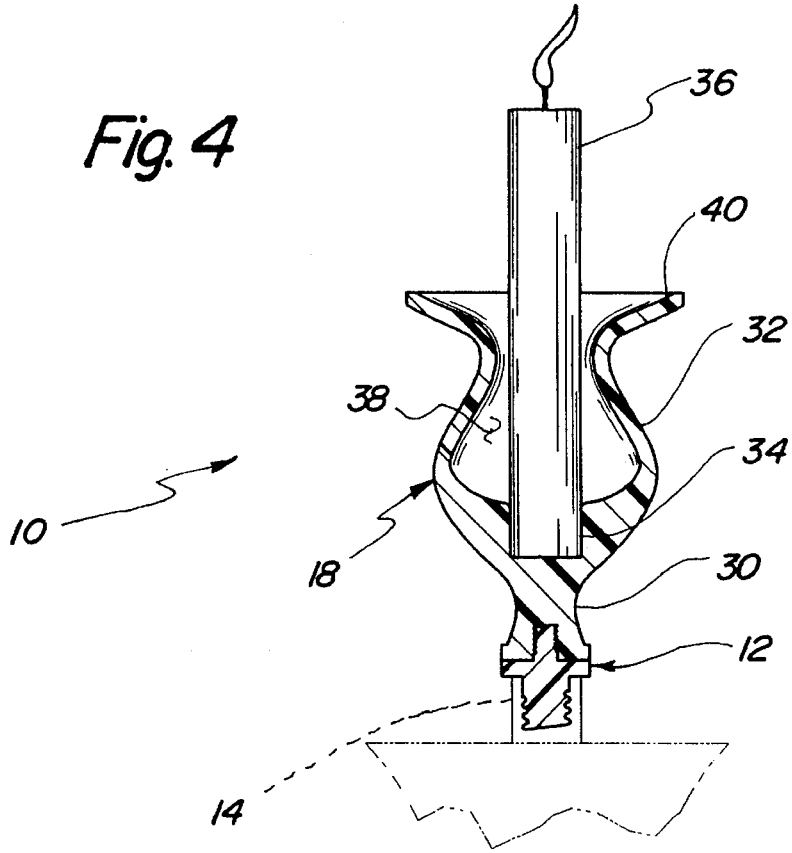
FIG. 4 is a cross sectional view taken along line 4—4 of FIG. 3.

As best illustrated in FIGS. 4 and 5, it can be shown that the mounting means 12 according to the present invention 10 comprises a substantially circular insulator plate 22 having a first diameter extending thereacross. A first threaded projection 24 is coupled to a lower surface of the insulator plate 22 and includes exterior threads cooperable with the interior threads found within the conventional light socket 14 of the associated light fixture 16. The first threaded projection 24 is of a second diameter, wherein the first diameter of the insulator plate 22 is substantially greater than the second diameter as illustrated. A second threaded projection 26 extends from an upper surface of the insulator plate 22 and is provided with exterior threads which engage interior threads formed into a portion of the candle engaging means 18. The second threaded projection 26 is of a third diameter, wherein the second diameter of the first threaded projection 24 is substantially greater than the second diameter to ensure a proper engagement of the mounting means 12 to the light socket 14 such that an annular seal 28 extending along a lower surface of the insulator plate 22 sealingly engages the upper peripheral edge of the light socket 14. The insulator plate 22, as well as the threaded projections 24 and 26, are preferably comprised of a dielectric material which precludes a conducting of electrical potential thereacross.

Figure 3:
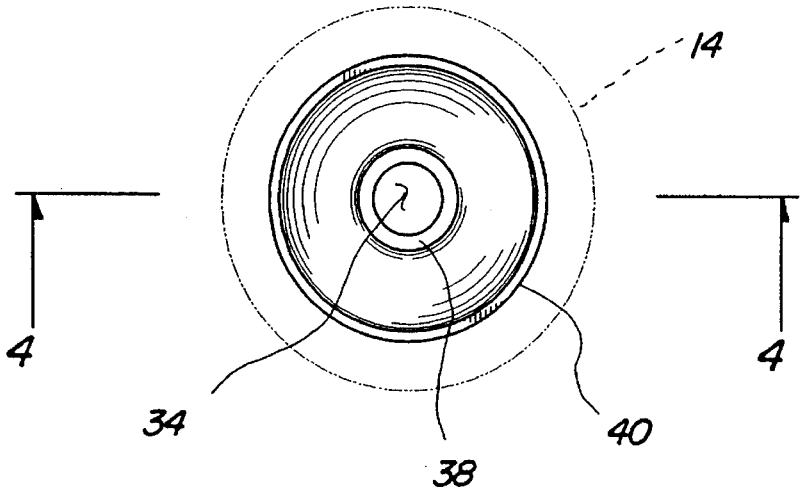
FIG. 3 is a top plan view of the invention.

As best illustrated in FIGS. 3 and 4, it can be shown that the candle engaging means 18 of the present invention 10 preferably comprises a mounting base 30 having an unlabeled cylindrical bore and including interior threads which can be threadably engaged to the exterior threads of the second threaded projection 26 so as to couple the mounting base to the mounting means 12. The candle engaging means 18 further comprises a main body 32 integrally or otherwise fixedly secured to the mounting base 30. The main body 32 is shaped so as to define a cylindrical bore 34 with an interior thereof which receives a lower most portion of a candle 36 to secure at least a portion of the candle within the main body 32. The main body 32 is substantially hollow in shape so as to define a wax reservoir 38 within which wax from the candle 36 can be deposited. The wax reservoir 38 of the main body 32 is of a greater diameter proximal to the cylindrical bore 34 and tapers to a lesser diameter proximal to an upper end of the main body 32, wherein the greater diameter is substantially larger than the lesser diameter. A conical wax guide 40 extends radially outward and slightly upward from the upper end of the main body 32 and serves to capture and direct wax flowing from the candle 36 into the wax reservoir 38. By this structure, a depositing of wax into the wax reservoir 38 will create a hardened wax wedge serving to preclude unintentional removal of the candle 36 from the candle engaging means 18.

In use, the light fixture candle adapter 10 according to the present invention can be easily installed to a light fixture 16, such as the chandelier illustrated in FIG. 1 or the lamp illustrated in FIG. 6 for example. A candle 36 can then be engaged to the candle engaging means 18 to provide for illumination in lieu of or in the absence of the electrically powered light bulbs typically used with such light fixtures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A light fixture candle adapter comprising:

a mounting means for coupling to a light socket of a light fixture;

and, a candle engaging means removably coupled to the mounting means for receiving and supporting a candle relative to the mounting means and for capturing wax dripping from the candle.

2. The light fixture candle adapter of claim 1, wherein the mounting means comprises a substantially circular insulator plate having a first diameter extending thereacross; a first threaded projection coupled to a lower surface of the insulator plate and including exterior threads cooperable with interior threads of a light fixture, the first threaded projection being of a second diameter, wherein the first diameter of the insulator plate is substantially greater than the second diameter; a second threaded projection extending from an upper surface of the insulator plate and including exterior threads which engage interior threads of the candle engaging means, the second threaded projection being of a third diameter, wherein the second diameter of the first threaded projection is substantially greater than the second diameter; and an annular seal extending along a lower surface of the insulator plate for sealingly engaging an upper peripheral edge of a light socket.

3. The light fixture candle adapter of claim 2, wherein the candle engaging means comprises a mounting base having a cylindrical bore and including interior threads which are threadably engaged to the exterior threads of the second threaded projection so as to couple the mounting base to the mounting means; a main body fixedly secured to the mounting base, the main body being shaped so as to define a cylindrical bore which receives a lower most portion of a candle to secure at least a portion of the candle within the main body, the main body being substantially hollow in shape so as to define a wax reservoir within which wax from the candle can be deposited, the wax reservoir of the main body being of a greater diameter proximal to the cylindrical bore and tapering to a lesser diameter proximal to an upper end of the main body, wherein the greater diameter is substantially larger than the lesser diameter such that a depositing of wax into the wax reservoir will create a hardened wax wedge serving to preclude unintentional removal of the candle from the candle engaging means.

4. The light fixture candle adapter of claim 3, wherein the candle engaging means further comprises a conical wax guide extending radially outward and slightly upward from an upper end of the main body for capturing and directing wax into the wax reservoir.

5. The light fixture candle adapter of claim 1, wherein the candle engaging means comprises a mounting base having a cylindrical bore and including interior threads which are threadably engaged to the mounting means; a main body fixedly secured to the mounting base, the main body being shaped so as to define a cylindrical bore which receives a lower most portion of a candle to secure at least a portion of the candle within the main body, the main body being substantially hollow in shape so as to define a wax reservoir within which wax from the candle can be deposited, the wax reservoir of the main body being of a greater diameter proximal to the cylindrical bore and tapering to a lesser diameter proximal to an upper end of the main body, wherein the greater diameter is substantially larger than the lesser diameter such that a depositing of wax into the wax reservoir will create a hardened wax wedge serving to preclude unintentional removal of the candle from the candle engaging means.

6. The light fixture candle adapter of claim 5, wherein the candle engaging means further comprises a conical wax guide extending radially outward and slightly upward from an upper end of the main body for capturing and directing wax into the wax reservoir.

* * * * *